US007714822B2

(12) United States Patent
Chen et al.

(10) Patent No.: US 7,714,822 B2
(45) Date of Patent: May 11, 2010

(54) LIQUID CRYSTAL DISPLAY DEVICE CAPABLE OF SWITCHING SCANNING FREQUENCIES

(75) Inventors: Chien-Yu Chen, Taipei Hsien (TW); Wen-Pin Chou, Hsin-Chu Hsien (TW)

(73) Assignee: NOVATEK Microelectronics Corp., Hsin-Chu (TW)

( * ) Notice: Subject to any disclaimer, the term of this patent is extended or adjusted under 35 U.S.C. 154(b) by 617 days.

(21) Appl. No.: 11/423,454

(22) Filed: Jun. 12, 2006

(65) Prior Publication Data

US 2007/0211003 A1 Sep. 13, 2007

(30) Foreign Application Priority Data

Mar. 8, 2006 (TW) ..... 95107784 A

(51) Int. Cl.
*G09G 3/36* (2006.01)
*G09G 5/00* (2006.01)

(52) U.S. Cl. ..... 345/87; 345/50; 345/38; 345/99; 345/213; 345/98; 345/102; 345/204; 345/208; 345/211; 345/212

(58) Field of Classification Search ..... 345/87, 345/348, 211, 213, 38, 50
See application file for complete search history.

(56) References Cited

U.S. PATENT DOCUMENTS

| | | | | |
|---|---|---|---|---|
| 5,450,222 | A * | 9/1995 | Sirkin | 349/150 |
| 5,528,494 | A * | 6/1996 | Moses | 702/4 |
| 5,825,345 | A * | 10/1998 | Takahama et al. | 345/104 |
| 6,087,982 | A * | 7/2000 | Liu | 342/185 |
| 6,278,777 | B1 * | 8/2001 | Morley et al. | 379/265.02 |
| 7,145,546 | B2 * | 12/2006 | Kang et al. | 345/102 |
| 7,211,771 | B1 * | 5/2007 | Smith et al. | 219/502 |
| 7,292,221 | B2 * | 11/2007 | Woo | 345/102 |
| 7,362,302 | B2 * | 4/2008 | Takaoka et al. | 345/99 |
| 7,362,303 | B2 * | 4/2008 | Jang | 345/102 |
| 2002/0044118 | A1 * | 4/2002 | Sekido et al. | 345/87 |
| 2006/0119617 | A1 * | 6/2006 | Toyooka et al. | 345/619 |
| 2008/0191995 | A1 * | 8/2008 | Cheon et al. | 345/101 |
| 2008/0211834 | A1 * | 9/2008 | Jang | 345/690 |

* cited by examiner

*Primary Examiner*—Richard Hjerpe
*Assistant Examiner*—Olga Merkoulova
(74) *Attorney, Agent, or Firm*—Winston Hsu

(57) ABSTRACT

A liquid crystal display device includes a noise-receiving module for receiving external noise signals, a liquid crystal display module, and a frequency-switching means for switching scanning frequencies of the liquid crystal display module according to frequencies of the noise signals received by the noise-receiving module.

16 Claims, 4 Drawing Sheets

LIQUID CRYSTAL DISPLAY DEVICE CAPABLE OF SWITCHING SCANNING FREQUENCIES

BACKGROUND OF THE INVENTION

1. Field of the Invention

The present invention relates to a liquid crystal display device capable of switching scanning frequencies and the driving method thereof, and more particularly, to a liquid crystal display device capable of switching scanning frequencies according to received noise signals and the driving method thereof.

2. Description of the Prior Art

The progress of science and technology has led to small, effective, and portable intelligent information products becoming a part of our lives. Display devices play an important role because all intelligent information products, such as mobile phones, personal digital assistants (PDAs), or notebooks, require display devices to function as a communication interface. The advantages of an LCD device include portability, low power consumption, and low radiation. Therefore, the LCD device is widely used in, for example, various portable products, such as notebooks and personal data assistants (PDA). Moreover, the LCD device is gradually replacing the CRT monitor for use with desktop computers. Nevertheless, liquid crystal molecules under different arrangements have different polarity against light therefore the liquid crystal molecules in different arrangements can control penetration of light to generate different intensity of outputted light, and the LCD device displays different color levels of red, blue and green by way of changing an arrangement of the liquid crystal molecules so as to display picture images.

A glittering frequency of a fluorescent lamp is due to an electric power frequency of a power supply. There are two different electric power frequencies (50 Hz, 60 Hz) applied in different regions all over the world. When a scanning frequency of a liquid crystal display device can not match the electric power frequency of the fluorescent lamp, users feel glittery and uncomfortable, especially for a monochrome LCD monitor with a reflective or semi-reflective backlight module, causing of that the fluorescent lamp provides light to the reflective or semi-reflective backlight module. Traditionally the solution is utilizing an interlaced scan technique or increasing the scanning frequency of the LCD monitor. However, first, the interlaced scan technique can not solve this problem entirely; second, users feel glittery and uncomfortable when the LCD monitor is shaken upward and downward; and third, increasing the scanning frequency of the LCD monitor causes disadvantages of power consumption and delay of liquid crystal molecules. There is a need to solve the problem mentioned above.

SUMMARY OF THE INVENTION

It is therefore a primary objective of the claimed invention to provide a liquid crystal display device capable of switching scanning frequencies and the driving method thereof for solving the above-mentioned problem.

According to the claimed invention, a liquid crystal display device includes a noise-receiving module for receiving external noise signals, a liquid crystal display module, and a frequency-switching means for switching scanning frequencies of the liquid crystal display module according to frequencies of the noise signals received by the noise-receiving module.

According to the claimed invention, a liquid crystal display drive IC for switching scanning frequencies of a liquid crystal display module is disclosed. The liquid crystal display drive IC includes a noise-receiving module for receiving external noise signals, and a frequency-switching means for switching scanning frequencies of the liquid crystal display module according to frequencies of the noise signals received by the noise-receiving module.

According to the claimed invention, a method for driving a liquid crystal display module includes: (a) receiving external noise signals; and (b) driving the liquid crystal display module according to frequencies of the noise signals received in step (a).

These and other objectives of the present invention will no doubt become obvious to those of ordinary skill in the art after reading the following detailed description of the preferred embodiment that is illustrated in the various figures and drawings.

DETAILED DESCRIPTION

Figure 1:
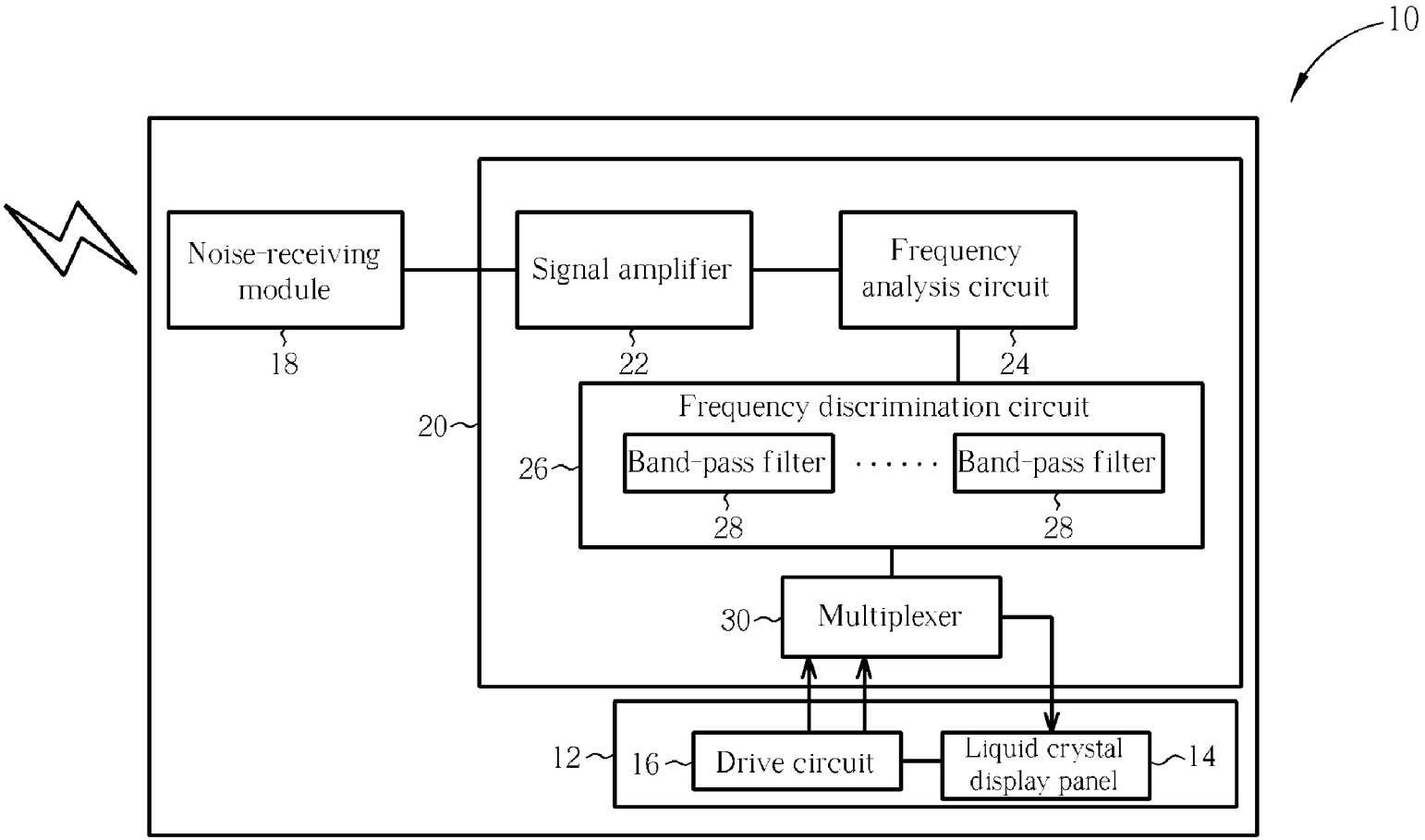
FIG. 1 is a functional block diagram of a liquid crystal display device according to the present invention.

Please refer to FIG. 1. FIG. 1 is a functional block diagram of a liquid crystal display device 10 according to the present invention. The liquid crystal display device 10 includes a liquid crystal display module 12 including a liquid crystal display panel 14 and a drive circuit 16 for driving the liquid crystal display panel 14 at different scanning frequencies. The drive circuit 16 can include a COM drive circuit and a SEG drive circuit. The liquid crystal display device 10 further includes a noise-receiving module 18 for receiving external noise signals. The noise-receiving module 18 can be a conducting wire of Indium Tin Oxide glass (ITO glass), an antenna module, and so on. The liquid crystal display device 10 further includes a frequency-switching means 20 coupled to the liquid crystal display module 12 for switching scanning frequencies of the liquid crystal display module 12 according to frequencies of the noise signals received by the noise-receiving module. The frequency-switching means 20 includes a signal amplifier 22 coupled to the noise-receiving module 18 for amplifying the noise signals received by the noise-receiving module 18, a frequency analysis circuit 24 coupled to the signal amplifier 22 for analyzing frequencies of the amplified noise signals, and a frequency discrimination circuit 26 coupled to the frequency analysis circuit 24 for discriminating a frequency of the noise signal with the largest signal energy according to an analysis result of the frequency analysis circuit 24. The frequency discrimination circuit 26 includes at least one band-pass filter 28 for filtering signals analyzed by the frequency analysis circuit 24. The amount of the band-pass filters 28 depends on the amount of the scanning frequencies to be switched. The frequency-switching means 20 further includes a multiplexer 30 coupled to the frequency discrimination circuit 26 for outputting a signal corresponding to the specific scanning frequency (such as 50

Hz or 60 Hz) generated by the drive circuit 16 to the liquid crystal display panel 14 according to a discrimination result of the frequency discrimination circuit 26. The drive circuit 16, the noise-receiving module 18, and the frequency-switching means 20 can be integrated in a liquid crystal display drive IC.

Figure 2:
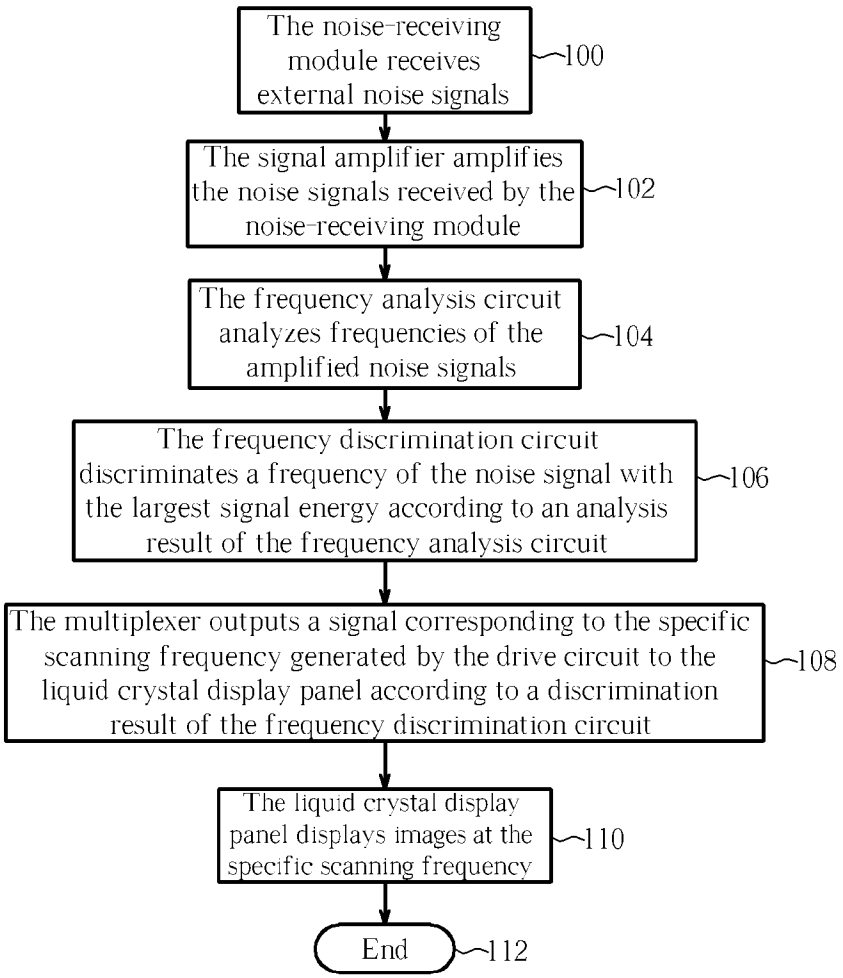
FIG. 2 is a flowchart of driving a liquid crystal display module according to the present invention.

Please refer to FIG. 2. FIG. 2 is a flowchart of driving the liquid crystal display module 12 according to the present invention. The method includes following steps:

Step 100: The noise-receiving module 18 receives external noise signals.

Step 102: The signal amplifier 22 amplifies the noise signals received by the noise-receiving module 18.

Step 104: The frequency analysis circuit 24 analyzes frequencies of the amplified noise signals.

Step 106: The frequency discrimination circuit 26 discriminates a frequency of the noise signal with the largest signal energy according to an analysis result of the frequency analysis circuit 24.

Step 108: The multiplexer 30 outputs a signal corresponding to the specific scanning frequency generated by the drive circuit 16 to the liquid crystal display panel 14 according to a discrimination result of the frequency discrimination circuit 26.

Step 110: The liquid crystal display panel 14 displays images at the specific scanning frequency.

Step 112: End.

Figure 3:
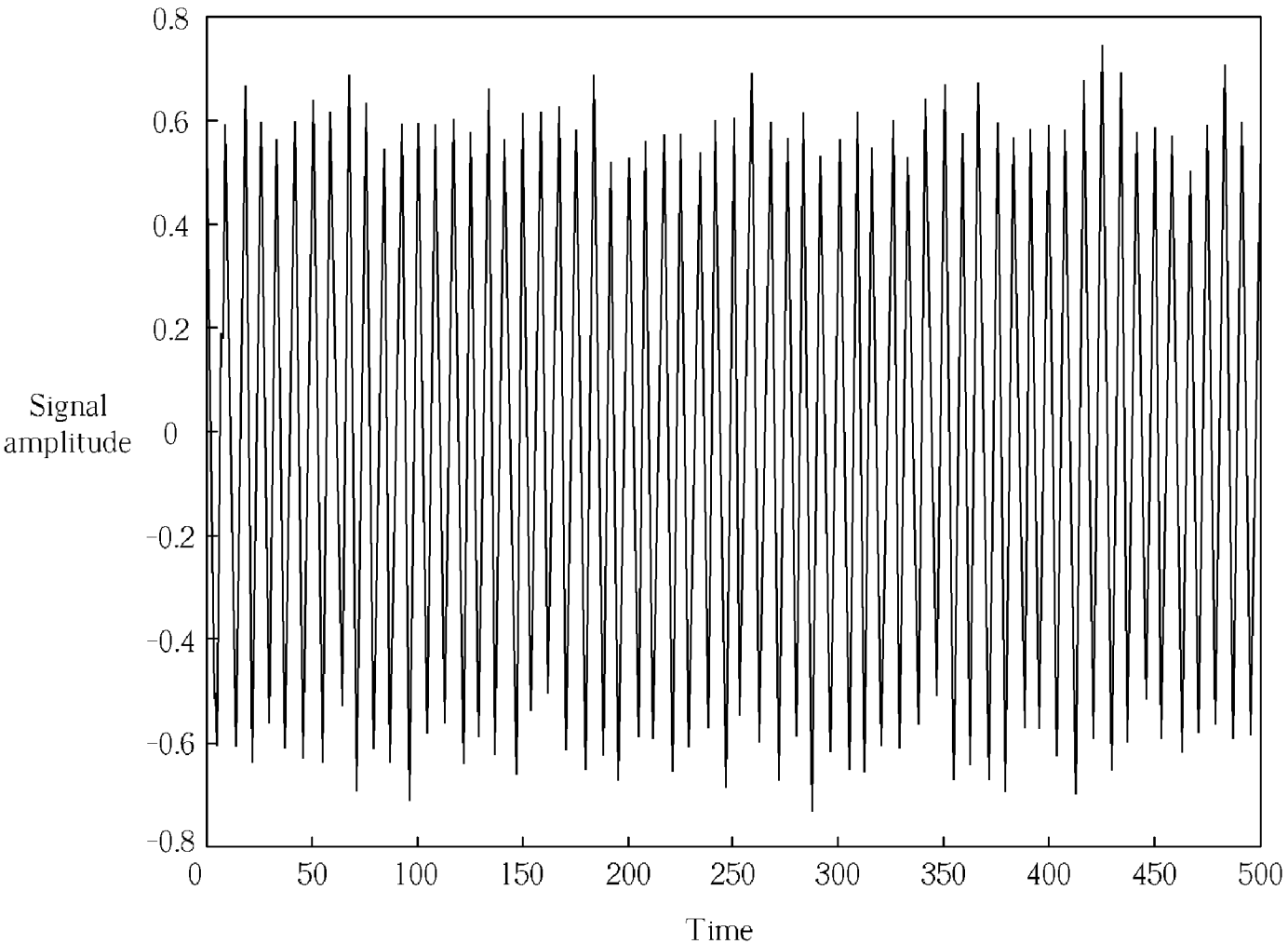
FIG. 3 is a time response diagram of the noise signals received by a noise-receiving module according to the present invention.
Figure 4:
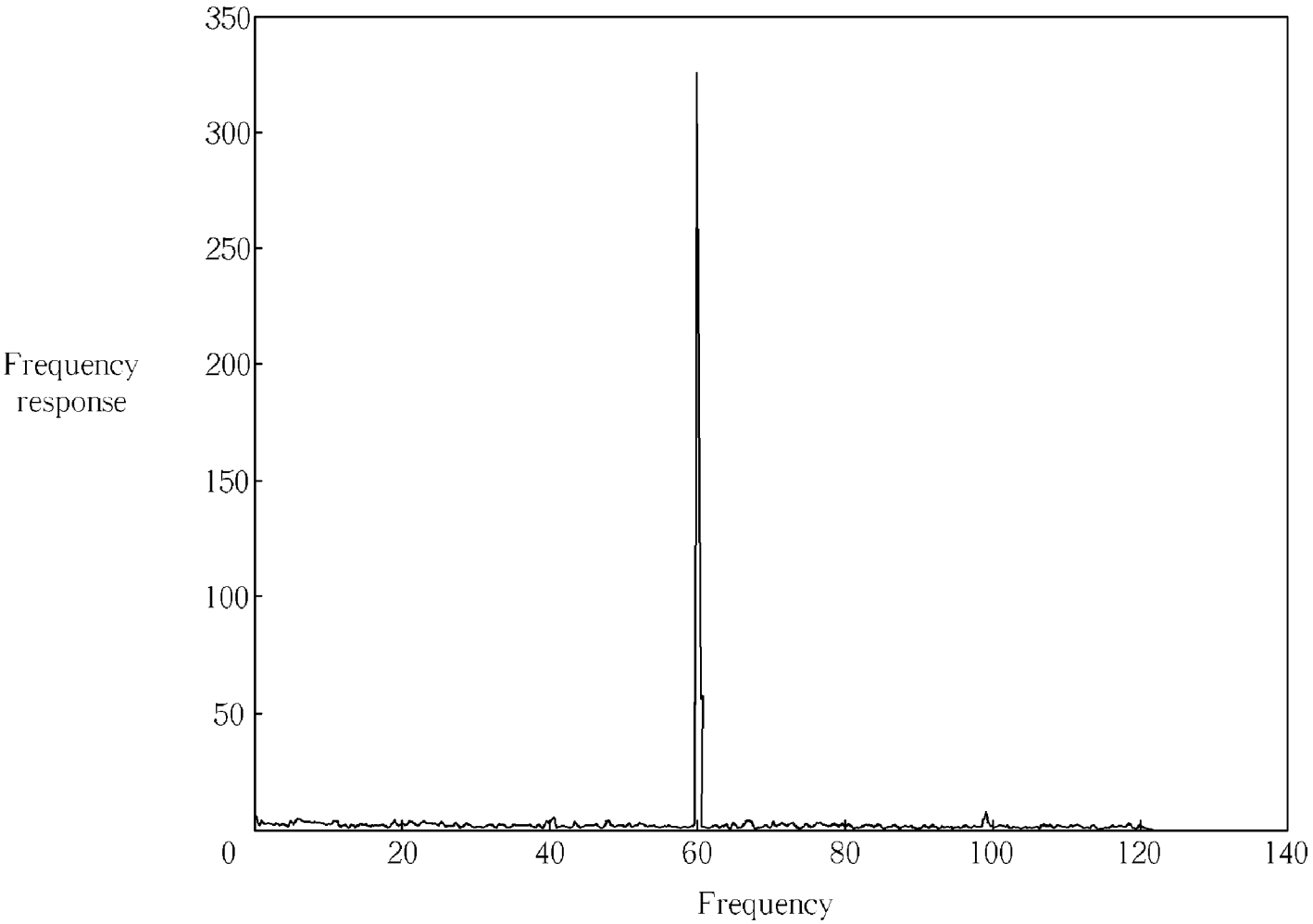
FIG. 4 is a frequency response diagram of the noise signals analyzed by a frequency analysis circuit according to the present invention.

First the noise-receiving module 18 receives external noise signals. For example, the electromagnetic field intensity of the noise signal at a frequency 50 Hz is greater than the electromagnetic field intensity of the noise signal at other frequency when locating in a region wherein the frequency of the power supply is 50 Hz, such as the region applying Phase Alternation Line (PAL) standard. The electromagnetic field intensity of the noise signal at a frequency 60 Hz is greater than the electromagnetic field intensity of the noise signal at other frequency when locating in a region wherein the frequency of the power supply is 60 Hz, such as the region applying National Television Standards Committee (NTSC) standard. The frequency of the fluorescent lamp can be obtained by utilizing the noise-receiving module 18 to detect the frequency of electromagnetic interference. The noise-receiving module 18 can be a conducting wire of Indium Tin Oxide glass of the liquid crystal display panel 14 for receiving noise signals. When the liquid crystal display device 10 is applied in portable communication devices, such as mobile phones and personal data assistants (PDA), the noise-receiving module 18 can be an antenna module for receiving noise signals as the wireless communication module of the portable communication devices. The noise signals received by the noise-receiving module 18 are transmitted to the signal amplifier 22 of the frequency-switching means 20, and the signal amplifier 22 amplifies the noise signals. Then the frequency analysis circuit 24 analyzes frequencies of the amplified noise signals. The frequency discrimination circuit 26 discriminates the frequency of the noise signal with the largest signal energy according to the analysis result of the frequency analysis circuit 24. For example, the band-pass filters 28 filter the noise signals at the frequencies 50 HZ and 60 Hz, and then the frequency discrimination circuit 26 discriminates which output peak value is greater with the band-pass filters 28 so as to discriminate that the frequency of the noise signal with the largest signal energy is 50 Hz or 60 Hz. Please refer to FIG. 3 and FIG. 4. FIG. 3 is a time response diagram of the noise signals received by the noise-receiving module 18 according to the present invention. FIG. 4 is a frequency response diagram of the noise signals analyzed by the frequency analysis circuit 24 according to the present invention. The frequency analysis circuit 24 can process spectrum analysis with the noise signals in time domain as shown in FIG. 3 to transform the noise signals in time domain into frequency domain. Then the frequency discrimination circuit 26 discriminates the frequency of the noise signal with the largest signal energy is 60 Hz so as to discriminate that the frequency of the power source is 60 Hz in that region.

Then the multiplexer 30 outputs the signal corresponding to the specific scanning frequency generated by the drive circuit 16 to the liquid crystal display panel 14 according to the discrimination result of the frequency discrimination circuit 26. For example, when the frequency discrimination circuit 26 discriminates the frequency of the noise signal with the largest signal energy is 50 Hz, the frequency discrimination circuit 26 outputs a corresponding selecting signal to the multiplexer 30. After the multiplexer 30 receives the corresponding selecting signal, the multiplexer 30 outputs a driving signal corresponding to the scanning frequency 50 Hz transmitted from the drive circuit 16 selectively to the liquid crystal display panel 14 so as to drive the liquid crystal display panel 14 to display images at the scanning frequency matching 50 Hz. Similarly when the frequency discrimination circuit 26 discriminates the frequency of the noise signal with the largest signal energy is 60 Hz, the frequency discrimination circuit 26 outputs a corresponding selecting signal to the multiplexer 30. After the multiplexer 30 receives the corresponding selecting signal, the multiplexer 30 outputs a driving signal corresponding to the scanning frequency 60 Hz transmitted from the drive circuit 16 selectively to the liquid crystal display panel 14 so as to drive the liquid crystal display panel 14 to display images at the scanning frequency matching 60 Hz.

In contrast to the conventional liquid crystal display device and the driving method thereof, the liquid crystal display device and the driving method thereof according to the present invention discriminate the frequency of the external noise signal with the largest signal energy for discriminating the frequency of the fluorescent lamp. The scanning frequency of the liquid crystal display device can be adjusted according to the discrimination result so as to match the scanning frequency of the liquid crystal display device with the frequency of the fluorescent lamp. The present invention solves the problem that users feel glittery and uncomfortable when the scanning frequency of the liquid crystal display device can not match the electric power frequency of the fluorescent lamp.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A liquid crystal display device comprising:

a noise-receiving module for receiving external noise signals resulted from an outside light source;

a liquid crystal display module; and a frequency-switching means for switching scanning frequencies of the liquid crystal display module according to frequencies of the noise signals received by the noise-receiving module.

2. The liquid crystal display device of claim 1 wherein the noise-receiving module is a conducting wire of Indium Tin Oxide glass (ITO glass).

3. The liquid crystal display device of claim 1 wherein the noise-receiving module is an antenna module.

4. The liquid crystal display device of claim 1 wherein the liquid crystal display module comprises:

a liquid crystal display panel; and a drive circuit for driving the liquid crystal display panel at different scanning frequencies.

5. The liquid crystal display device of claim 1 wherein the frequency-switching means comprises:

a frequency analysis circuit for analyzing frequencies of the noise signals received by the noise-receiving module;

a frequency discrimination circuit coupled to the frequency analysis circuit for discriminating a frequency of the noise signal with the largest signal energy according to an analysis result of the frequency analysis circuit; and a multiplexer coupled to the frequency discrimination circuit for generating a corresponding signal to the liquid crystal display module according to a discrimination result of the frequency discrimination circuit.

6. The liquid crystal display device of claim 5 wherein the frequency discrimination circuit comprises a band-pass filter for filtering signals analyzed by the frequency analysis circuit.

7. The liquid crystal display device of claim 1 wherein the frequency-switching means comprises a signal amplifier coupled to the noise-receiving module for amplifying the noise signals received by the noise-receiving module.

8. A liquid crystal display drive IC for switching scanning frequencies of a liquid crystal display module, the liquid crystal display drive IC comprising:

a noise-receiving module for receiving external noise signals resulted from an outside light source; and a frequency-switching means for switching scanning frequencies of the liquid crystal display module according to frequencies of the noise signals received by the noise-receiving module.

9. The liquid crystal display drive IC of claim 8 wherein the noise-receiving module is a conducting wire of Indium Tin Oxide glass (ITO glass).

10. The liquid crystal display drive IC of claim 8 wherein the frequency-switching means comprises:

a frequency analysis circuit for analyzing frequencies of the noise signals received by the noise-receiving module;

a frequency discrimination circuit coupled to the frequency analysis circuit drive for discriminating a frequency of the noise signal with the largest signal energy according to an analysis result of the frequency analysis circuit; and a multiplexer coupled to the frequency discrimination circuit for generating a corresponding signal to the liquid crystal display module according to a discrimination result of the frequency discrimination circuit.

11. The liquid crystal display drive IC of claim 10 wherein the frequency discrimination circuit comprises a band-pass filter for filtering signals analyzed by the frequency analysis circuit.

12. The liquid crystal display drive IC of claim 8 wherein the frequency-switching means comprises a signal amplifier coupled to the noise-receiving module for amplifying the noise signals received by the noise-receiving module.

13. A method for driving a liquid crystal display module comprising:

(a) receiving external noise signals resulted from an outside light source; and (b) switching scanning frequencies of the liquid crystal module according to frequencies of the noise signals received in step (a).

14. The method of claim 13 wherein step (b) comprises:

(c) analyzing the frequencies of the noise signals;

(d) discriminating a frequency of the noise signal with the largest signal energy according to an analysis result in step (c); and (e) driving the liquid crystal display module at a corresponding scanning frequency according to a discrimination result in step (d).

15. The method of claim 14 wherein step (e) comprises:

driving the liquid crystal display module at a scanning frequency corresponding to the frequency of the noise signal with the largest signal energy according to a discrimination result in step (d).

16. The method of claim 13 further comprising:

amplifying the noise signals received in step (a).

* * * * *